US008844738B2

(12) United States Patent
Thompson

(10) Patent No.: US 8,844,738 B2
(45) Date of Patent: Sep. 30, 2014

(54) FOLDABLE LIFTING APPARATUS

(76) Inventor: Scott R Thompson, Hettinger, ND (US)

( * ) Notice: Subject to any disclaimer, the term of this patent is extended or adjusted under 35 U.S.C. 154(b) by 190 days.

(21) Appl. No.: 13/246,313

(22) Filed: Sep. 27, 2011

(65) Prior Publication Data

US 2013/0075353 A1 Mar. 28, 2013

(51) Int. Cl.

| | |
|---|---|
| ***B66C 23/26*** | (2006.01) |
| ***B66C 23/48*** | (2006.01) |
| ***B66C 23/44*** | (2006.01) |
| ***B66C 23/16*** | (2006.01) |

(52) U.S. Cl.

CPC ..... *B66C 23/166* (2013.01); *B66C 23/48* (2013.01); *B66C 23/44* (2013.01)

USPC ..... 212/294; 212/295; 212/180; 414/543

(58) Field of Classification Search

CPC .... B66C 23/36; B66C 23/365; B66C 623/42; B66C 23/44

USPC ..... 212/179–180, 294–295, 299–300, 258, 212/181; 414/534, 543, 541–542, 546, 550

See application file for complete search history.

(56) References Cited

U.S. PATENT DOCUMENTS

| | | | |
|---|---|---|---|
| 3,854,594 | A | 12/1974 | Brookes |
| 3,972,433 | A | 8/1976 | Reed |
| 4,024,971 | A | 5/1977 | Rohrer |
| 4,121,695 | A | 10/1978 | Carpenter |
| 4,127,200 | A | 11/1978 | Mann |
| 4,269,561 | A | 5/1981 | Rutten |
| 4,274,788 | A | 6/1981 | Sutton |
| 4,391,379 | A | 7/1983 | Paffrath |
| 4,398,858 | A | 8/1983 | Paffrath |
| 4,406,574 | A | 9/1983 | Riley |
| 4,412,635 | A | 11/1983 | Bateman |
| 4,417,665 | A | 11/1983 | Adeline |
| 4,419,038 | A | 12/1983 | Pendergraft |
| 4,597,498 | A | 7/1986 | Spinosa |
| 4,604,022 | A | 8/1986 | Bourgraf |
| 4,685,860 | A | 8/1987 | McFarland |

(Continued)

FOREIGN PATENT DOCUMENTS

EP 089614 A2 9/1993

OTHER PUBLICATIONS http://www.jcwhitney.com/autoparts/Product/showCustonn-0/Pr-p_Product.CATENTRY_ID:2010395/c-10101/Nty-1/p-2010395/Ntx-mode+matchallpartial/N-10101/tf-Browse/s-10101/Ntk-.

(Continued)

*Primary Examiner* — Michael Mansen
*Assistant Examiner* — Nathaniel Adams

(57) ABSTRACT

The present invention is a self-locking folding crane apparatus that can be installed onto any pivot shaft and held in place by small positioning devices such as clamps, slip-rings, bolts, shaft collars, pins, and other mechanical means; a substantial base is not needed to support the hoist as long as the pivot shaft is able to do so. The resulting hoist can be recoverably installed and optionally left on a vehicle or cart while it is in either an operative or stowed state. Unlike all other portable cranes that were found in prior art either singly or in combination, the present invention requires no assembly or disassembly between uses.

21 Claims, 15 Drawing Sheets

(56) References Cited

U.S. PATENT DOCUMENTS

| | | | | |
|---|---|---|---|---|
| 4,746,263 | A | 5/1988 | Cook | |
| 4,881,864 | A | 11/1989 | Amato | |
| 5,014,863 | A | 5/1991 | Vlaanderen | |
| 5,205,700 | A | 4/1993 | Lin | |
| 5,211,526 | A | 5/1993 | Robinette | |
| 5,232,329 | A | 8/1993 | Livingston | |
| 5,308,214 | A | 5/1994 | Crain | |
| 5,431,526 | A | 7/1995 | Peterson | |
| 5,662,451 | A | 9/1997 | Muzzi | |
| 5,752,799 | A | 5/1998 | Carey | |
| 5,788,095 | A | 8/1998 | Watson | |
| 5,800,117 | A | 9/1998 | Milton | |
| 5,810,547 | A | 9/1998 | Bruno | |
| 5,993,137 | A | 11/1999 | Harr | |
| 6,007,289 | A | 12/1999 | Kruse | |
| 6,042,328 | A | 3/2000 | McVaug | |
| 6,082,561 | A | 7/2000 | Bembas | |
| 6,152,675 | A | 11/2000 | Compton | |
| 6,202,868 | B1 * | 3/2001 | Murray | 212/294 |
| 6,309,170 | B1 | 10/2001 | Vartanian | |
| 6,460,908 | B1 * | 10/2002 | Green | 293/117 |
| 6,461,097 | B1 | 10/2002 | Ablabutyan | |
| 6,478,528 | B1 * | 11/2002 | Asbury | 414/543 |
| 6,578,722 | B2 | 6/2003 | Perkins | |
| 6,585,474 | B1 | 7/2003 | Kameda | |
| 6,655,895 | B1 | 12/2003 | Dahl | |
| 6,705,821 | B2 | 3/2004 | Phillips | |
| 6,705,824 | B2 | 3/2004 | Ablabutyan | |
| 6,726,435 | B1 | 4/2004 | Williams | |
| 6,783,315 | B1 | 8/2004 | Senechal | |
| 6,821,075 | B2 | 11/2004 | Van der Horn | |
| 6,830,423 | B1 | 12/2004 | Williams | |
| 6,887,027 | B2 | 5/2005 | O'Leary | |
| 6,921,007 | B1 | 7/2005 | Guerrant | |
| 6,981,834 | B1 | 1/2006 | Henry | |
| 7,156,246 | B2 | 1/2007 | Sherrod | |
| 7,717,663 | B1 | 5/2010 | Stowers | |
| 2004/0026675 | A1 * | 2/2004 | Green et al. | 254/326 |
| 2008/0149583 | A1 | 6/2008 | Welker | |
| 2009/0230071 | A1 * | 9/2009 | Thompson | 212/292 |
| 2011/0053482 | A1 * | 3/2011 | McKenzie | 452/187 |

OTHER PUBLICATIONS http://grablock.cabserver.net/specifications_hh.html.
http://autoaccessories4less.com/hitchhoist/HitchHoist.pdf.
http://www.prohoists.com/Shopping.idc?ProductID=6
&ProductCategory=5.
http://www.autochair.co.uk/Store/WheelchairScooterLifts/
TheKgKgScooterLifts0027.aspx.
http://hitches4less.stores.yahoo.net/hitch-hoist--portable-truck-
crane-.html.
http://www.harmarmobility.com/thescooterstore/.
http://www.harmar.com/.

* cited by examiner

FOLDABLE LIFTING APPARATUS

CROSS REFERENCE TO RELATED APPLICATIONS

None

STATEMENT REGARDING FEDERALLY SPONSORED RESEARCH

None

FIELD OF THE INVENTION

The present invention relates to the field of cranes, hoists, and lifting devices.

BACKGROUND OF THE INVENTION

This invention teaches improvements to portable hoists that are mountable to vehicles, building structures, carts, trailers, and the like. Examples in prior art are abundant and include teachings by Harr and Cary who introduce portable cranes in U.S. Pat. Nos. 5,752,799 and 5,993,137. Kruse teaches a in U.S. Pat. No. 6,007,289 that mounts into a receiver hitch and uses a jig to stabilize and increase the lifting capability of a hoist that is designed for powered mobility chairs. Williams teaches a portable mobility chair crane in U.S. Pat. No. 6,830,423 that engages a vehicle receiver adapter. Robinette teaches a low-pivot-point lift in U.S. Pat. No. 5,211,526 that does not have a hinge point.

Spitsburgen teaches a portable lift in U.S. Pat. No. 6,499,610 for medium to heavy applications. The '610 apparatus is readily assembled before each use and can be disassembled after use for easy storage. The Spitsburgen lift is mountable to vehicles, equipment, trailers, and building structures. Griffith teaches recoverable installation of a hitch hoist that is suitable for heavier objects in Canadian Patent 2,108,107. Davis teaches a multi-purpose hoist in U.S. Pat. No. 5,749,697 with top and bottom components mate together during assembly. Likewise Barger teaches a portable crane in U.S. patent application Ser. No. 10/657,029 that is adaptable to shop work benches, vehicles, and other stable structures. Amato teaches a swingable boom-type portable crane in U.S. Pat. No. 4,881,864 that engages the receiver hitch of a vehicle.

Compton teaches a collapsible hoist in U.S. Pat. No. 6,152,675 that has a sufficiently high center mast to elevate hunting game; the hoist is assembled, installed, and subsequently removed between uses. A collapsible hoist taught by Perkins in U.S. Pat. No. 6,578,722 also engages a vehicle receiver hitch and has a telescoping mast that is able to achieve a sufficient height to raise tall objects. Phillip and Angel teach similar game hoists in U.S. Pat. Nos. 6,705,821 and 7,201,552.

Other exemplary embodiments are described in U.S. Pat. Nos. 6,478,528, 6,386,820, 5,520,498, 5,445,487, 5,014,863, 7,300,238, 6,981,834, 6,860,703, 6,138,991, 6,089,431, 6,082,561, 5,810,547, 5,788,095, 5,800,117, 5,662,451, 4,417,665 and US patent application publication 20110206488.

All examples and combinations of examples of portable cranes found in prior art rely on assembly before use and disassembly after use. Among the above listed examples, the '675, '522, '722 and '821 cranes share the additional common drawback that they do not pivot. US Patent Application US2009/0067968 A1 also teaches a portable crane that requires assembly between uses and does not pivot. Prior art is quick to point out that each phase of assembly can be performed in as little as 2 minutes.

The present invention unveils a notable improvement by teaching a hoist that unfolds into a usable state in as little as 2 seconds and folds into a stowed state just as quickly. No assembly is required to transition the present invention in an operable state and no disassembly is required to revert the present invention back into a stowed state. To achieve this improvement over prior art the present invention combines a low profile pivoting hinge with latching and stopping surfaces, a hinge mounted mast with latching and stopping surfaces, and a hinge mounted boom with latches and stopping surfaces that automatically lock the hoist into operable and stored states as it is folded or unfolded. Nothing found in prior art or any combination thereof is seen to describe the present invention.

BRIEF SUMMARY OF THE INVENTION

This invention teaches improvements to foldable hoists by teaching a pivot shaft mountable hoist that unfolds from a stowed state and self locks into a usable state without the need for assembly, latches, fasteners, pins, or connectors. To achieve a folding operation improvement over prior art, the present invention combines a pivot that is hinge coupled to a stanchion in a manner that causes the two pieces to lock against each other and hold the stanchion largely vertical. This pivoting hinge and stanchion configuration is combined with boom and boom lock that are hinge coupled in a manner that causes the boom lock to drop in place and lock the boom against the stanchion when it is unfolded. The boom is locked relative to the stanchion in a manner that maintains a locked configuration between the stanchion and pivoting hinge. The simple step of unfolding the hoist is sufficient to bring it from a folded state into an operative state. Other improvements over prior art include knee-operable rotational load control, safety measures to enable the apparatus to remain assembled and engaged to a receiver hitch while in tow, the capability to fold into a stowed state without additional steps to disassemble or secure the hoist, and a pivoting hinge that is designed to engage the stanchion and pivot shaft in a manner that improves lifting capacity and product safety.

DESCRIPTION OF THE DRAWINGS

Further features, advantages, and benefits of this invention, as well as the structure and operation of various embodiments thereof, are described in detail below with reference to the accompanying drawings. In the drawings, like reference numbers generally indicate identical, functionally similar, and/or structurally similar elements. The drawing in which an element first appears is indicated by the leftmost digits in the corresponding reference number. The drawings disclosed herein are illustrative of preferred and sample embodiments of the disclosed invention and are not intended to limit the spirit or scope thereof.

FIG. 9 shows a plurality of installation points on a trailer that are adapted to mount a plurality of pivot shafts that can be rotationally coupled the pivoting hinge of the present invention to.

DETAILED DESCRIPTION OF PREFERRED EMBODIMENTS

Figure 1:
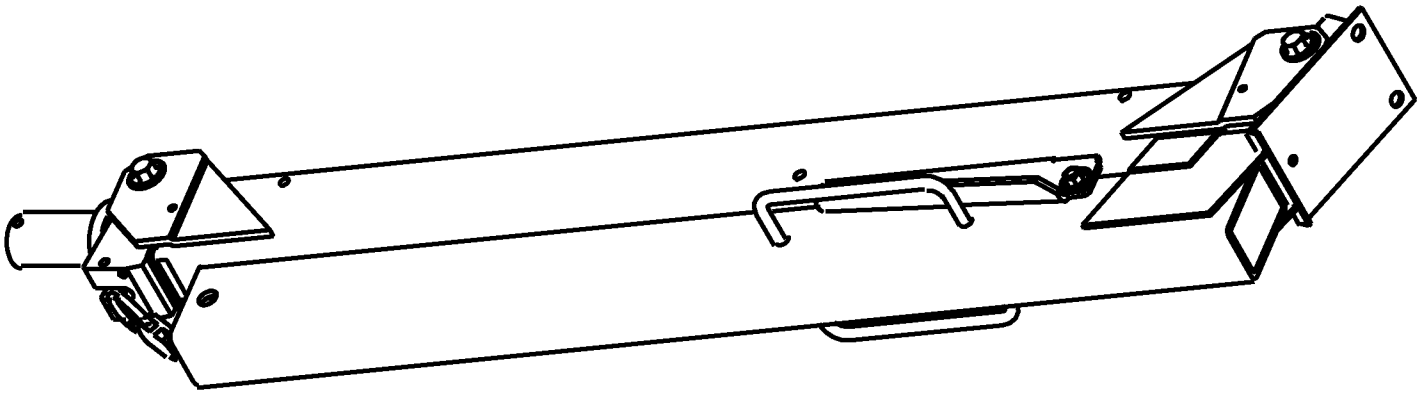
FIG. 1 shows a preferred embodiment of the present invention.
Figure 2:
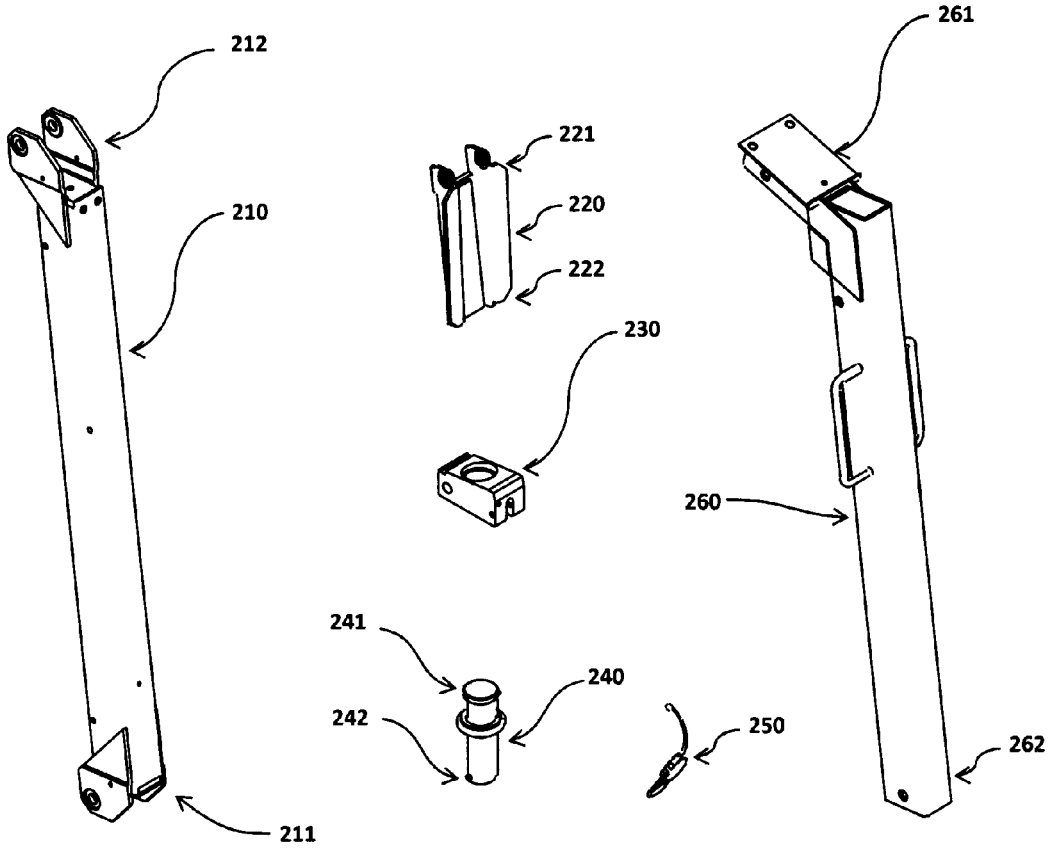
FIG. 2 shows essential components of a preferred embodiment of the present invention.

The present invention is a portable crane that is able to fold in and out of operative states without the need for assembly or disassembly between uses and is able to remain assembled while in tow. Essential components of this invention include a pivot shaft 240, boom lock 220, load coupler 250, and an assembly comprising a stanchion 210, pivoting hinge assembly 230, and boom 260; all having contact surfaces that engage to lock the hoist into an operative state when it is unfolded.

Figure 17:
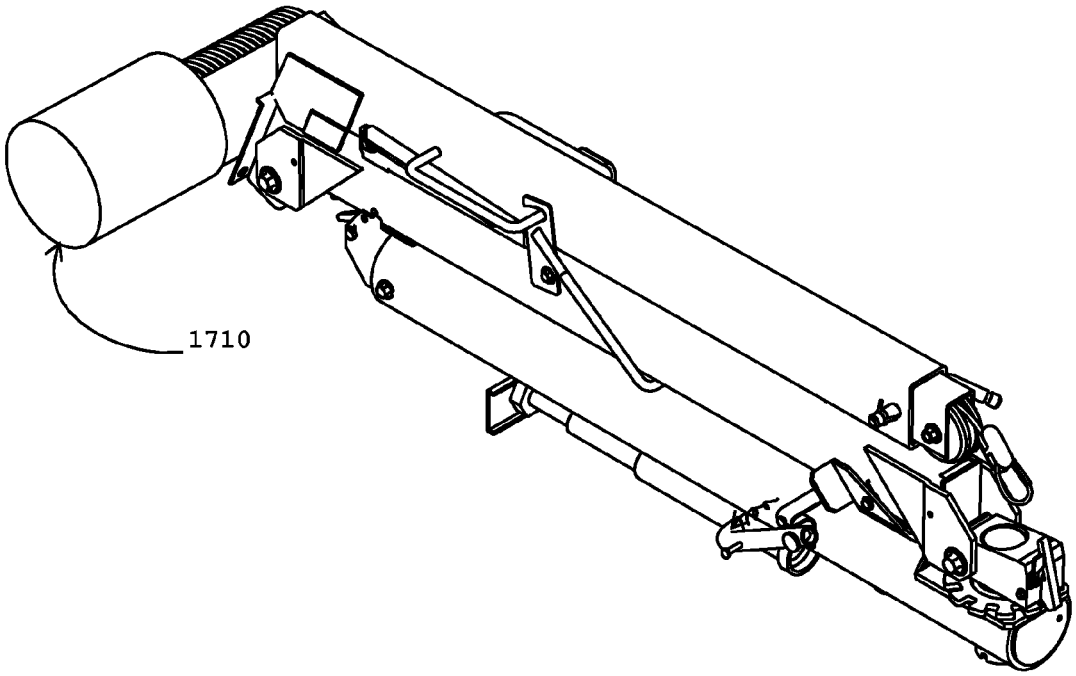
FIG. 17 shows an electric winch that is mounted to a preferred embodiment of the present invention in a stowed state.
Figure 18:
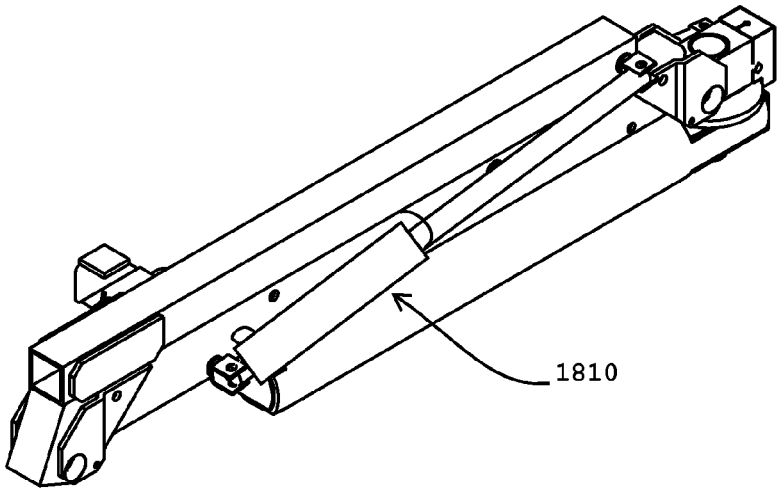
FIG. 18 shows a preferred embodiment of the present invention that uses actuators to induce movement.
Figure 19:
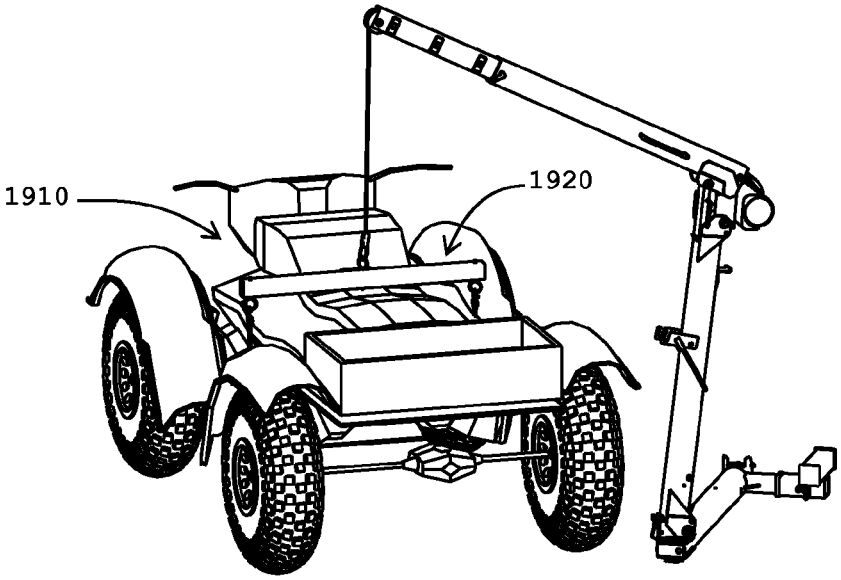
FIG. 19 shows a preferred embodiment of the present invention coupled to an all-terrain vehicle on the load side and to a receiver hitch at the mounting engagement point.

Embodiments of this invention are shown unfolded into an operative state in FIGS. 19 thru 22 in the drawings. The stanchion generally rests in a horizontal position when folded into a stowed state. Embodiments of this invention are shown folded into a stowed state in FIGS. 16 thru 18.

The term "stanchion" refers herein to a component of the hoist 210 that operates as a substantially vertical mast when the hoist is unfolded into an operable state. The stanchion 210 of the present invention has a contact surface at the proximal end 211 that engages the distal surface of a pivoting hinge 231 to lock the hoist as it is unfolded. The stanchion 210 also has a locking surface at the distal end 212 that engages the proximal surface 221 of the boom lock. The pivoting hinge 230 and the boom lock 220 are defined below.

Figure 3:
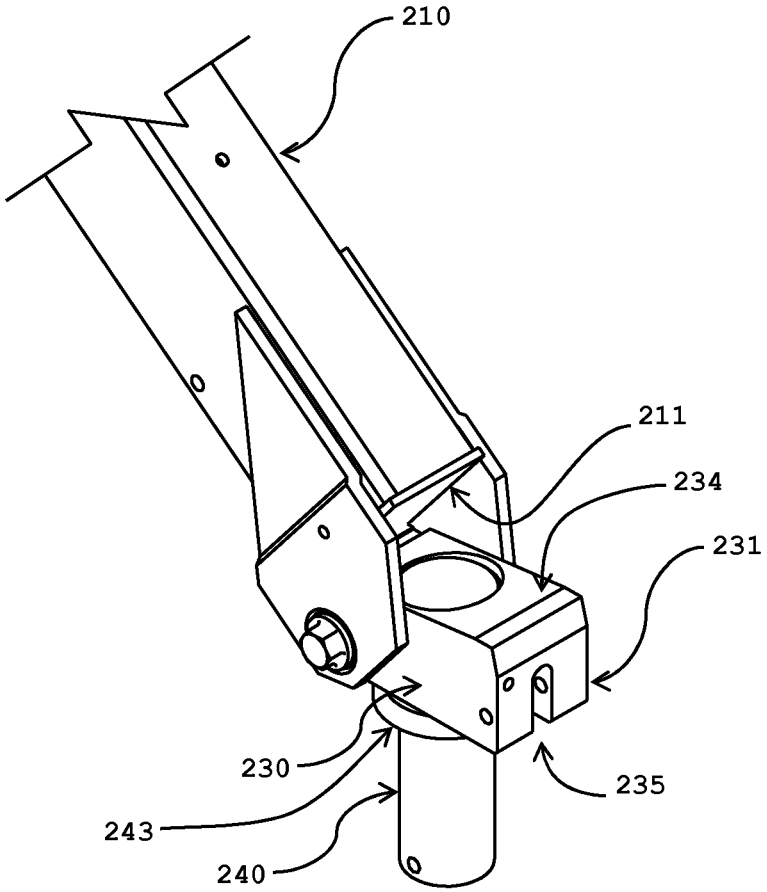
FIG. 3 shows how mating surfaces are used to lock an embodiment of the present invention into an operable state.
Figure 4:
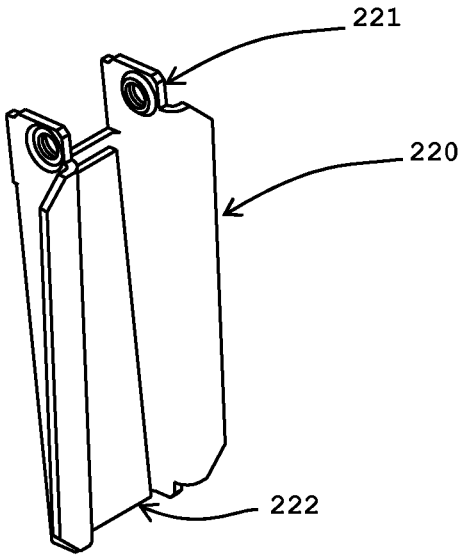
FIG. 4 shows a boom lock that is used to lock the boom into an operable state.

The term "pivoting hinge" refers herein to a component 230 that is hinge coupled to the proximal end of the stanchion 210, has a substantially horizontal distal surface 234 that engages the locking surface at the proximal end 211 of the stanchion as it is unfolded into a locked operative position. FIG. 3 shows how the pivoting hinge 230 and the stanchion 210 are assembled and how the locking surfaces of each component mate as a preferred embodiment unfolds.

Figure 6:
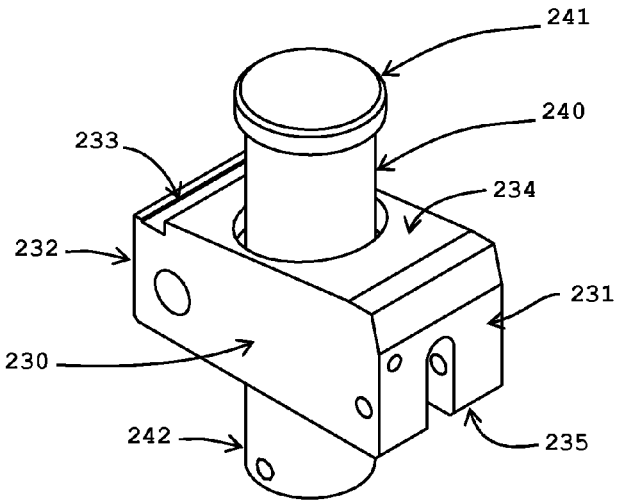
FIG. 6 shows how the pivot shaft and pivoting hinge mate in a preferred embodiment of the present invention.
Figure 7:
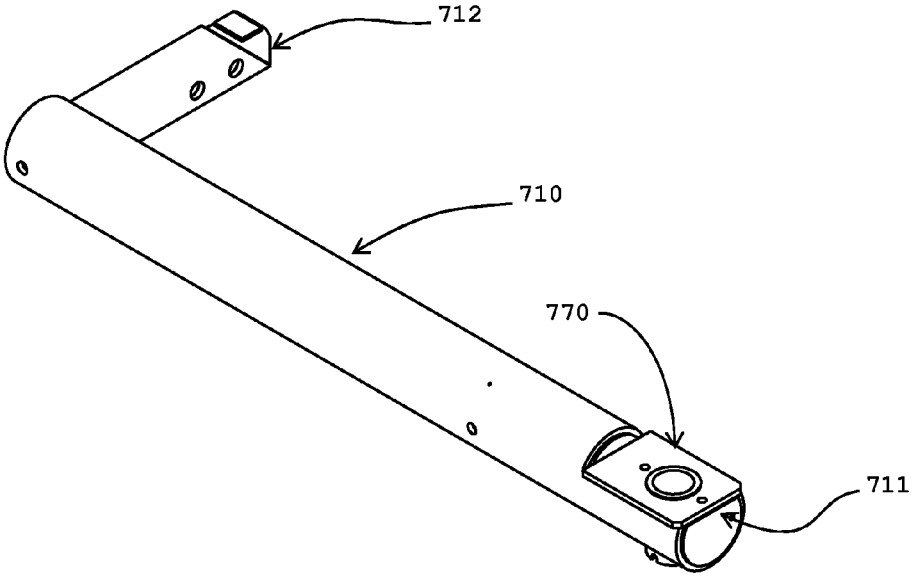
FIG. 7 shows a recoverable installable vehicle base mount that engages the pivot shaft of a preferred embodiment of the present invention.
Figure 8:
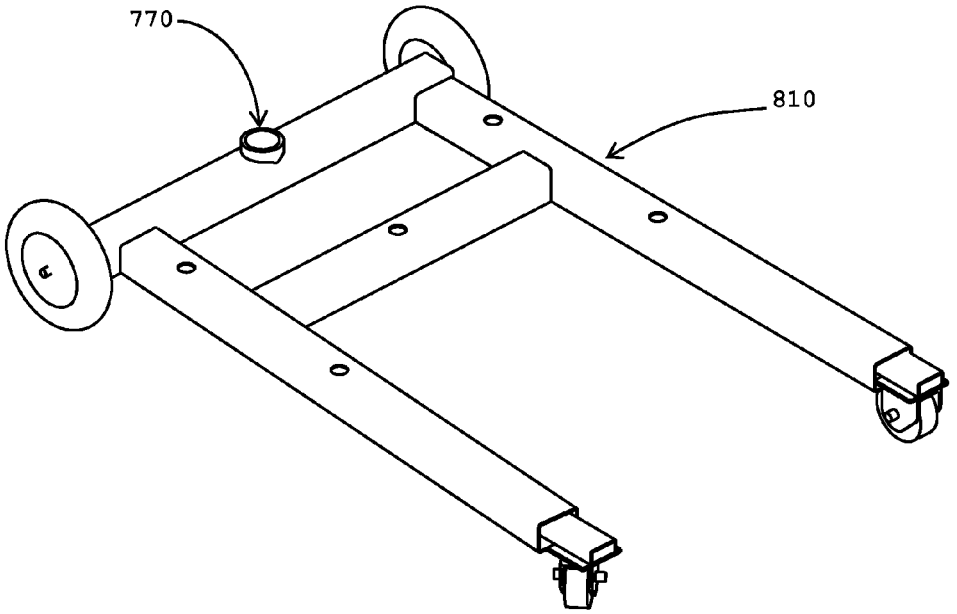
FIG. 8 shows a portable base mount that engages the pivot shaft of a preferred embodiment of the present invention to form an engine hoist.
Figure 9:
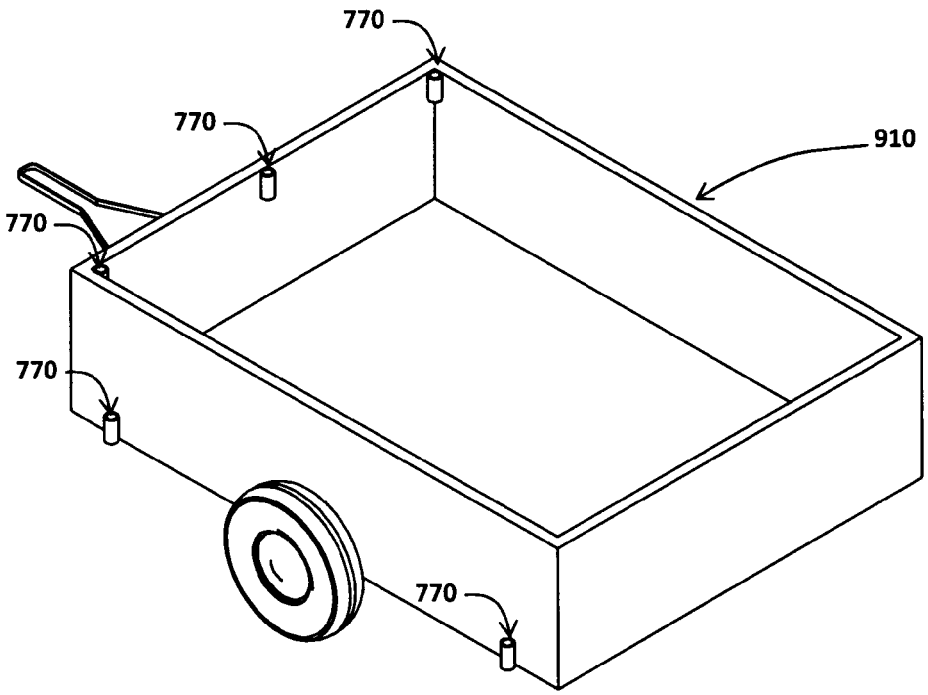
Figure 10:
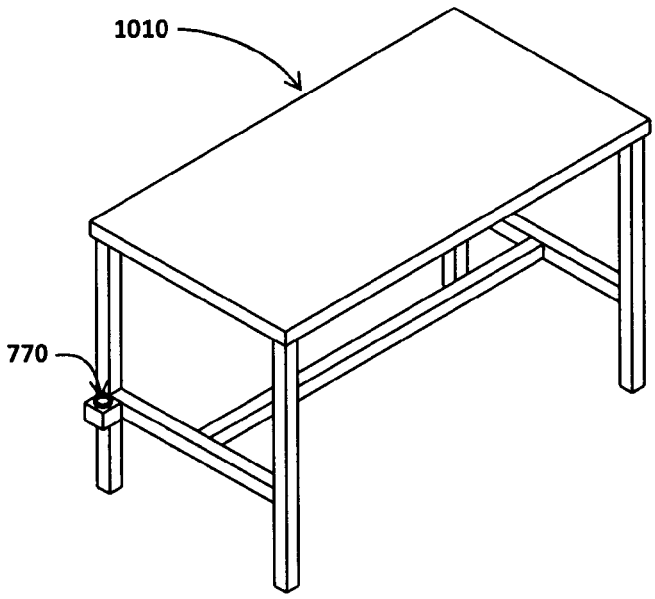
FIG. 10 shows an installation point on a work table that is adapted to mount a pivot shaft that can be rotationally coupled to the pivoting hinge of the present invention.
Figure 11:
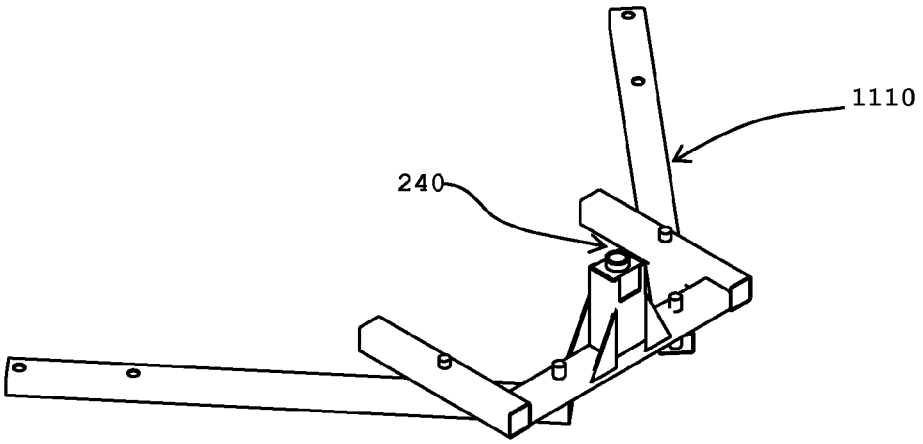
FIG. 11 shows a base mount that has a pivot shaft that can be rotationally coupled to the pivoting hinge of the present invention to render the present invention capable of mounting onto a roof, floor, or wall.
Figure 12:
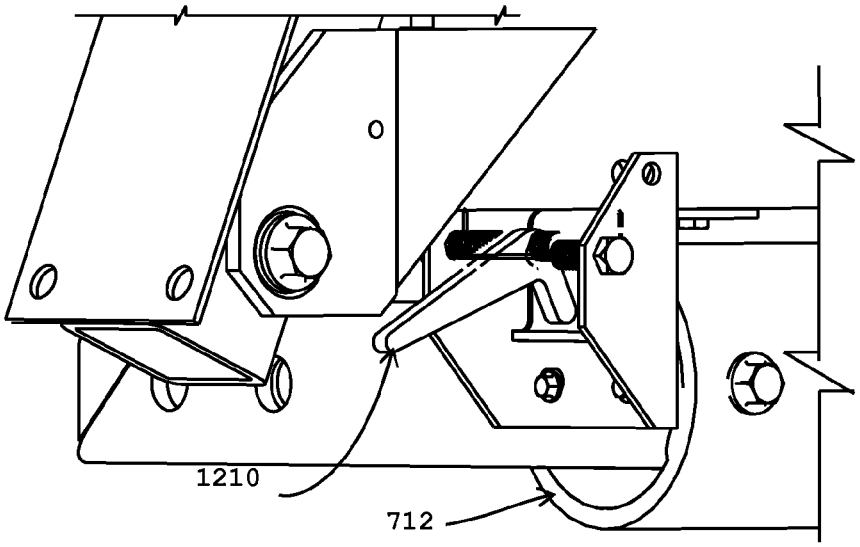
FIG. 12 shows an optional stowage latch that automatically engages the stanchion as it is folded into base mount of a preferred embodiment of the present invention.

The term "pivot shaft" refers herein to a substantially cylindrical shaped shaft 240 that is rotationally coupled to a pivoting hinge 230 and physically coupled to any structure capable of supporting the hoist 770, 901 and load when the hoist is in use. FIG. 6 shows how the pivot shaft in one embodiment is passed through the pivoting hinge to form a rotationally coupled union between both components. FIG. 7 shows a plurality of open cylinders 770 that can be engaged by a cylindrical shaped open shaft and a cylindrical shaped pivot shaft 240 equipped with a pivoting hinge positioning nut 902 and adaptively coupled to one of the cylinders 770 that can be rotationally coupled directly to the pivoting hinge 230. The cylindrical shaped pivot shaft 240 can also be welded or mechanically coupled to the trailer in this example without engaging one of the open cylinders 770.

The term "boom" refers to a lifting arm 260 that is adaptively coupled to a load coupling device 250 when the hoist is in use. The boom 260 is substantially horizontal in both operational and stowed states in preferred embodiments of this invention.

The terms "boom lock" refers to a latch 220 that is hinged coupled at the proximal end 221 to the proximal region 261 of the boom 260 and has at least one locking surface at its distal end 222 that engages a locking surface near the proximal end 212 of the stanchion 210 as this invention is unfolded into an operable state.

The term "mounting base" refers to any structure that is capable of supporting the crane assembly and load during use and adaptable to be rotationally coupled to the pivoting hinge 230. The mounting base can be a male cylindrical shaft capable of direct engagement to the pivoting hinge or a female cylindrical opening 710, 810, 910, 1010, 1110 capable of engaging a male cylindrical shaft that is already rotationally coupled to the pivoting hinge.

The term "insert adapter" refers herein to a substantially horizontal component of the base mount 711 that is designed to engage a vehicle adapter such as a receiver hitch during recoverable installation and removal.

Preferred embodiments of the present invention employ additional latches 1210, 1310, 1610, jigs 1510, boom extenders 1410, actuators 1810, and winches 1630, 1710 to improve performance or utility of the present invention for specific applications.

The term "base latch" refers herein to a latching mechanism 1210 that engages and secures the distal end 211 of the stanchion 210 to any surface on the mounting base as the present invention is folded into a stowed state.

The term "stanchion latch" refers herein to a latching mechanism 1310 that engages and secures the stanchion 210 to the boom 260 as the present invention is folded into a stowed state.

The term "boom extender" refers herein to an insert 1410 that is preferably attached to a load coupler and can be inserted into the boom 260 to collectively extend the reach of the boom 260. The adaptively coupled position of boom extender 1410 inside the boom 260 is adjustable in preferred embodiments.

The term "kick-stand jig" refers herein to a hinge mounted jig 1510 that operates substantially in the same manner as a kick-stand. The jig relies on a spring 1520 or other means of mechanical tension to force the jig to snap into operable and stowed states. The top of the jig includes an upper surface that engages and locks to a lower surface on the mounting base when the jig is unfolded into an operable state.

The term "rotational swing lock" refers herein to a rotational latch 1620 at the base of the pivoting hinge that is capable of adaptively coupling with a plurality of surfaces 1621 at the proximal end 211 of the stanchion 210 or the proximal end 235 of the pivoting hinge 230 to control pivotal rotation.

The term "tilt lock" refers herein to a releasable latch 1610 at the proximal end 211 of the stanchion 210 that engages a locking surface 233 on the pivoting hinge 230 to prevent the stanchion 260 from folding backward into a stowed state while it is unfolded into an operative state.

Preferred Embodiments

In preferred embodiments, the pivoting hinge 230 serves as a supporting stop for the stanchion 210 as it is unfolded, the boom lock 220 drops and locks into place as the lifting arm 260 is raised into operating position, and safety latches 1210, 1310 engage the stanchion 210 and boom 260 when it is folded back into storage. Preferred embodiments position the pivoting hinge 230 at a low elevation on the structure to give a folded embodiment of the present invention a low profile.

Preferred embodiments rely on two essential features to improve lifting capacity and operational safety; namely a pivoting hinge 230 that adaptively couples to the stanchion 210, and a pivot shaft 240 that is rotationally coupled through the pivoting hinge 230. The pivoting hinge 230 and pivot shaft 240 mate by passing the pivot shaft 240 through a substantially vertical cylindrical opening in the pivoting hinge 230. In preferred embodiments the vertical height of the cylindrical opening on the pivoting hinge 230 is substantial enough to distribute force along the shaft 240.

Figure 22:
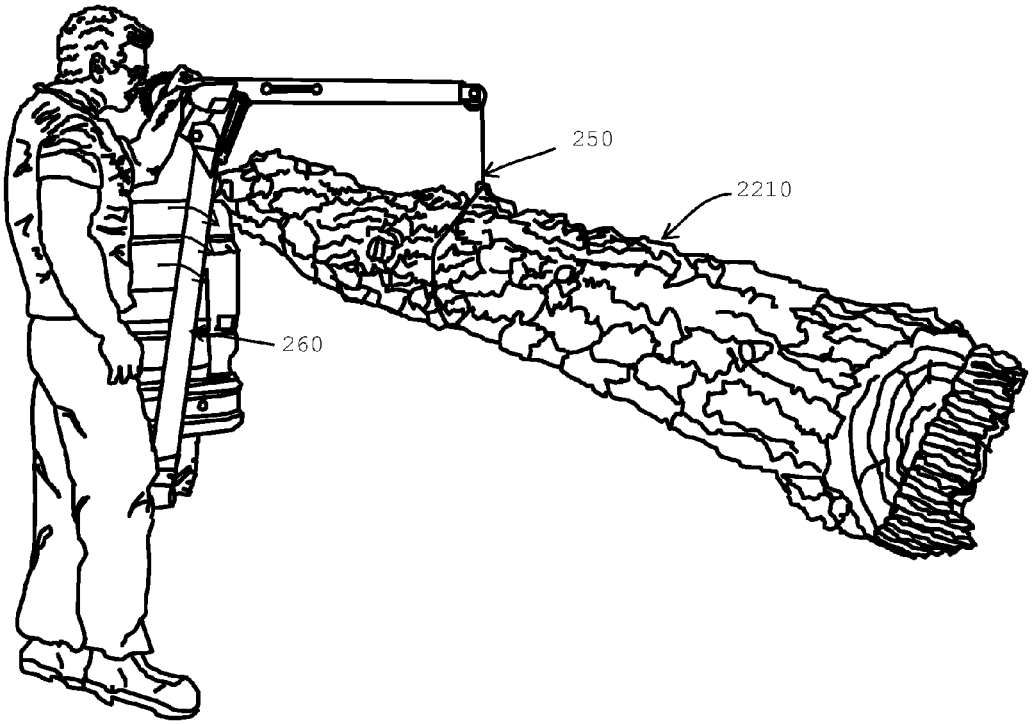
FIG. 22 shows how a preferred embodiment of the present invention leans over while lifting a log that is beyond the lifting capacity of the crane.

In preferred embodiments, the pivot shaft 240 is designed to be a weak point in the apparatus that slowly bends to lower a load that is heavy enough to induce failure in the crane. The sample illustration in FIG. 22 shows how a properly designed pivot shaft allows the stanchion 260 to lean over and lower the load as an oversized log 2210 induces failure in the hoist.

Figure 13:
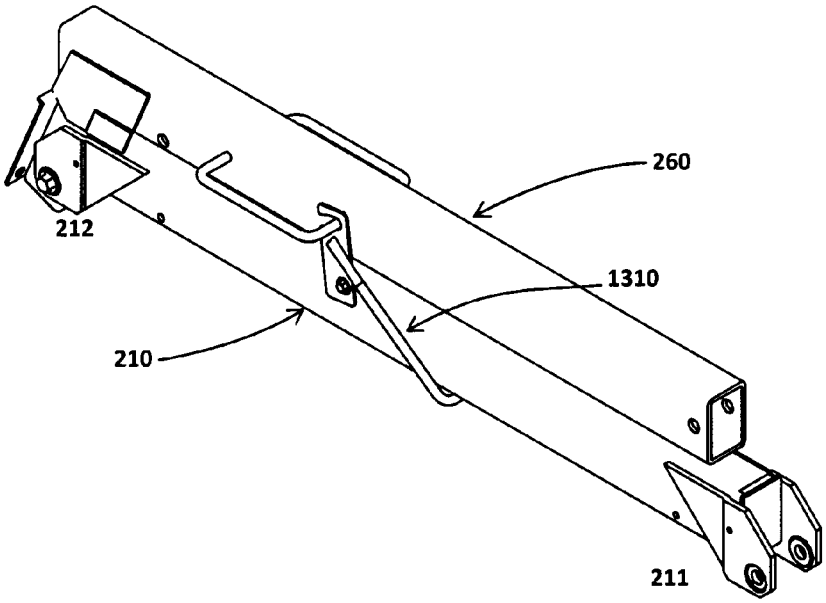
FIG. 13 shows an optional stowage latch that engages the boom as it is folded into the stanchion of a preferred embodiment of the present invention.
Figure 14B:
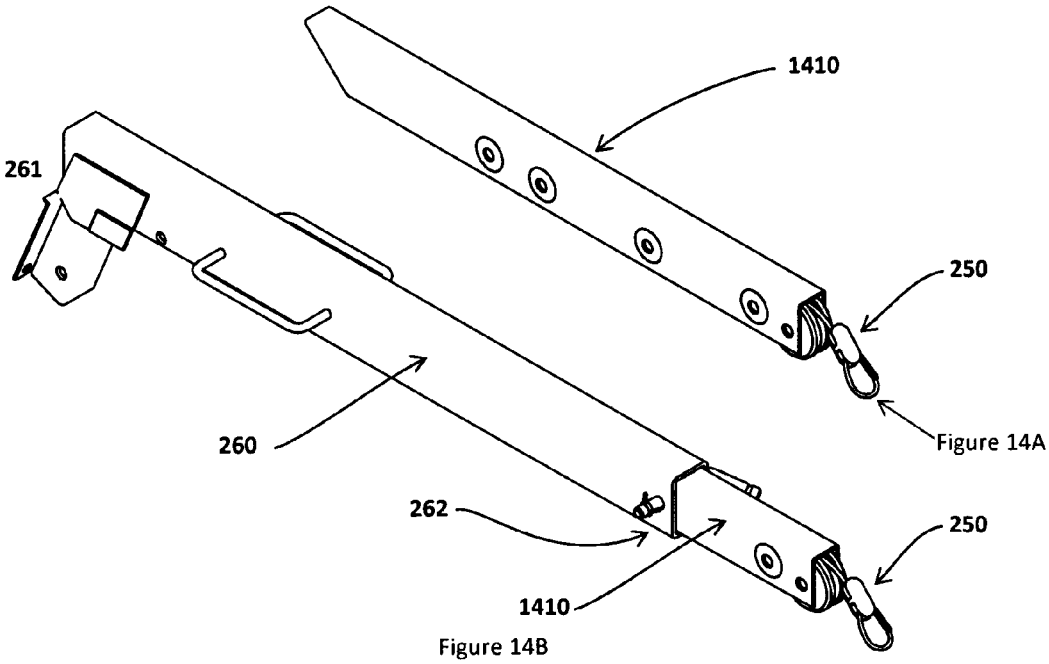
FIG. 14 shows a structural tube that engages the boom of a preferred embodiment of the present invention to form an extendable boom.
Figure 16:
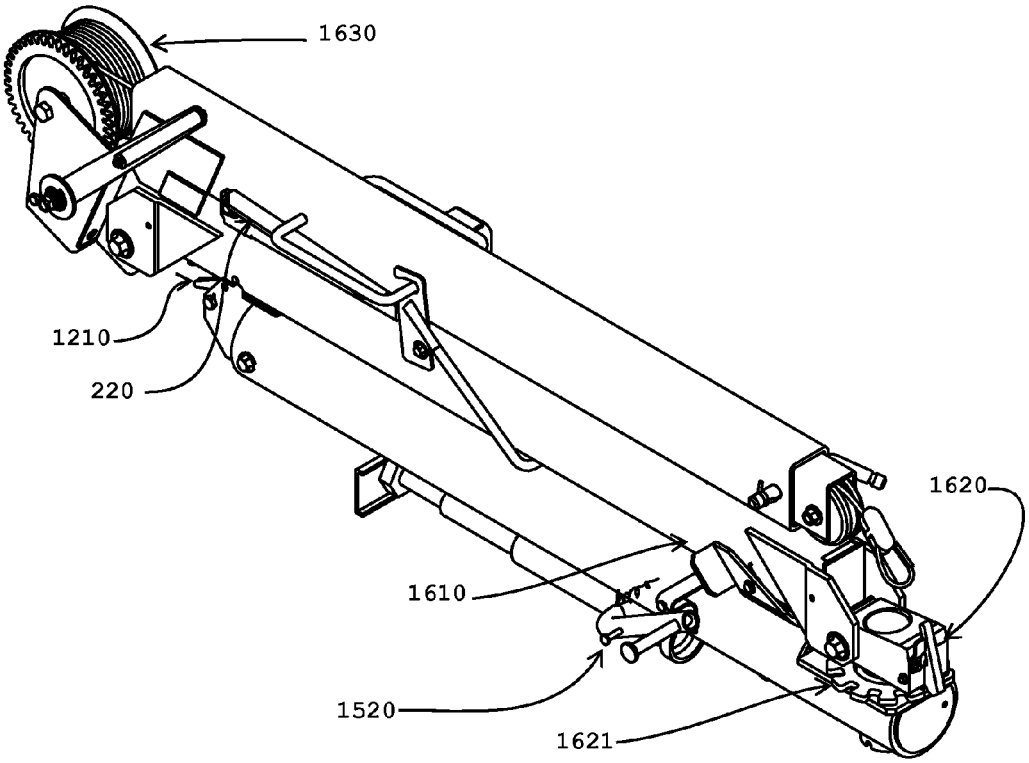
FIG. 16 shows a hand-brake winch, a rotational swing lock, and an optional latch that is used to prevent a preferred embodiment of the present invention from unintentionally folding out of an operative state.

Assembly of the essential components comprises the steps of rotationally coupling the pivoting hinge 230 and pivot shaft 240 as shown in FIG. 6, hinge coupling the pivoting hinge 230 to the proximal end 211 of the stanchion 210 as shown in FIG. 3, hinge coupling the proximal end 261 of the boom to the distal end 212 of the stanchion as illustrated in FIG. 13, hinge coupling the proximal end 221 of the boom lock 220 to the proximal region 261 of the boom 260 as shown in FIG. 16, and adaptively attaching a load coupler 250 to the distal end 262 of the boom 260 as shown with an optional boom extender 1410 in FIG. 14. The above assembly is then adaptively coupled to an insert 770. The exemplary insert adapters 770 shown in the Figures are for illustrative purposes and are not intended to limit the scope of this invention.

A preferred assembly of the pivot shaft 240 and pivoting hinge 230 is shown in FIG. 6. The pivot shaft 240 optionally has a cold-head, nut, clamp, pin, slip-ring, or other mechanical fastening device at the distal end 241 to prevent the pivoting hinge 230 from slipping off. Slip rings, pins, threaded adapters, shaft collars and the like 243 affixed to the pivot shaft 240 are preferably used to vertically position the proximal base of the pivoting hinge 235 on the pivot shaft 240. In preferred embodiments the pivoting hinge 230 spans a distance along the pivot shaft 240 that is greater than or equal to the diameter of the pivot shaft 240. A pivoting hinge 230 may span a shorter distance along the pivot shaft 230 for embodiments of this invention that are intended for lighter loads. Select embodiments include a mechanical means to couple the pivot shaft 240 to a mounting base 770 at the distal end 242 of the pivot shaft. The exemplary embodiments shown in the figures use a fastening pin.

Preferred embodiments of the pivoting hinge 230 have a substantially horizontal upper surface 234 that engages the proximal end 211 of the stanchion as it is unfolded into a locked operating position. The upper surface 234 of the pivoting hinge is optionally angled slightly downward toward the proximal end 232 of the pivoting hinge 230. The distal end 234 of the pivoting hinge 230 preferably has a substantially horizontal locking surface 233 that engages a tilt lock 1610 to prevent unintentional folding of the stanchion 210 when in use.

The pivoting hinge 230 and stanchion 210 are preferably hinge coupled in a manner that maximizes surface contact between the distal end 211 of the stanchion 210 and the upper surface 231 of the pivoting hinge 230. An exemplary embodiment of the pivoting hinge 230 and stanchion 210 assembly is shown in FIG. 3.

Preferred embodiments of the boom lock 220 include a hinge coupling point at the proximal end 222 and a locking surface at the distal end 221 that engages a locking surface at the proximal end 212 of the stanchion 210. Bends and gussets along the edges of the boom lock 220 are preferably used to enhance strength.

Figure 5:
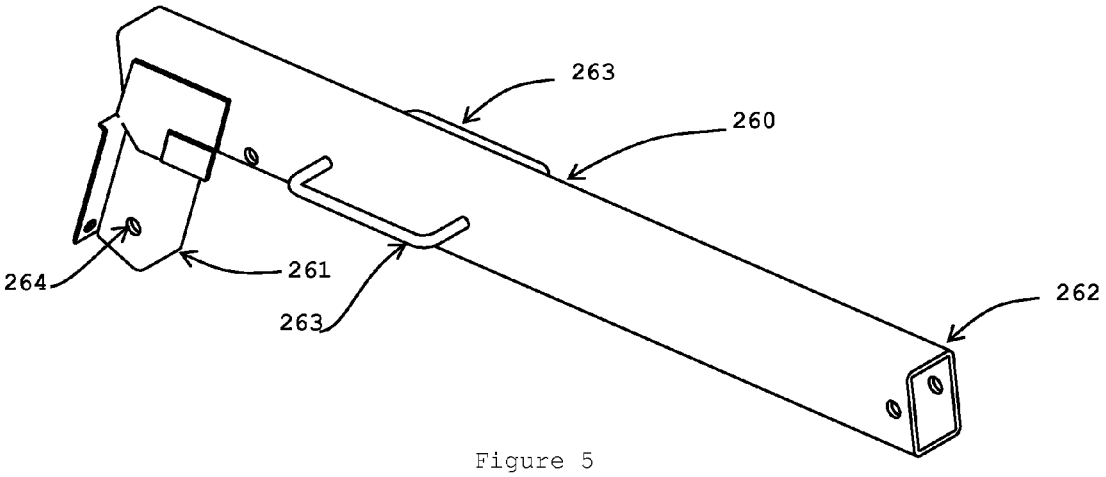
FIG. 5 shows a boom that is adaptable for use with boom lock of the present invention.

Preferred boom 260 embodiments include a hinge coupling point 264 that is offset slightly from the center of the proximal end 261 as shown in FIG. 5. The boom 260 embodiment shown in FIG. 5 includes handles 263 for transporting and operating the hoist and for coupling to the stanchion latch 1310 shown in FIG. 13.

Preferred base latch embodiments 1210 include a spring affixed to the latch to ensure proper engagement to a mating surface 712 on the mounting base 710.

Embodiments of the pivot shaft are adaptively attachable to any plurality of mounting bases. Exemplary embodiments of mounting bases include a vehicle receiver hitch mounting base 710, a base to a portable cart or portable engine hoist 810, mounting base attachments for trailers and portable carts 910, adaptable inserts for tables or working benches 1010, and adaptable inserts for roof, floor, and wall mounts 1110.

Figures 15A, 15B, 15C:
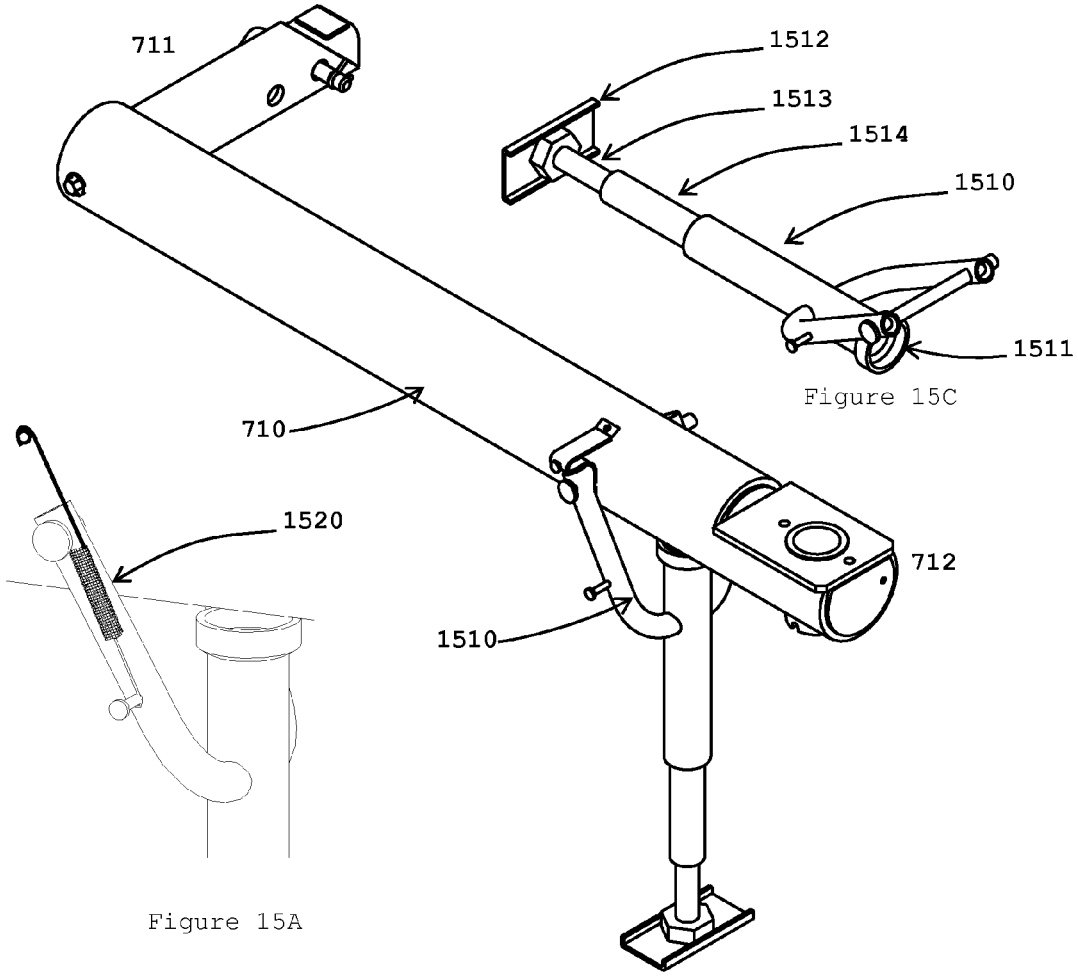
FIG. 15 shows a kickstand style jig that is mounted to a vehicle receiver hitch adapter of a preferred embodiment of the present invention.

The mounting base embodiment 710 shown in FIG. 15 is well suited for use with vehicles that have a receiver hitch. The mounting base 710 includes a substantially horizontal tube with an adapter at the proximal end 711 intended for recoverable engagement into a vehicle receiver hitch and an insert adapter 770 at the proximal end 712 that adaptively couples to the pivot shaft 240.

Preferred embodiments of the receiver hitch adaptable mounting base 710 include a kick-stand style jig 1510 at the distal region 712 of the mounting base 710. The kickstand jig includes a hinge coupling point that is offset from the distal end 1511, a plurality of segments 1513, 1514 that provide height adjustment, a base at the proximal end 1512, and a spring 1520 or other mechanical means to force the kickstand jig to snap into operable and stowed states as it is folded and unfolded.

Accessories such as hand-brake winches 1630, electric winches 1710, and actuators 1810 are interchangeably attachable to preferred embodiments of the present invention.

Preferred Methods

Essential steps of the preferred method include disengaging latches and locks and unfolding the apparatus from a stowed state, ensuring that all latches and locks that lock the hoist into an operative state are engaged before use, coupling the apparatus to a load, raising the load, optionally engaging a rotational latch to control pivotal rotation, swinging the load into a desired position, lowering the load, uncoupling the hoist from the load, swinging the hoist over the mounting base, and disengaging all latches and locks that lock the hoist into an operative state, folding the apparatus back into a stowed state, and ensuring that all latches and locks that lock the apparatus into a stowed state are engaged.

It is optimal to use this invention on a level surface to minimize the threat of damage to the hoist, host vehicle, or payload and further to impede the threat injury to the hoist operator. If this invention is used on an uneven surface, a preferred method is to level the hoist by making height adjustments to the kickstand jig 1510. If a load must be lifted from an uneven or un-level surface, a preferred method to prevent damage or personal injury is to engage the rotational swing latch until the load can be transported to a level surface.

Exemplary Uses of Preferred Embodiments

Figure 20:
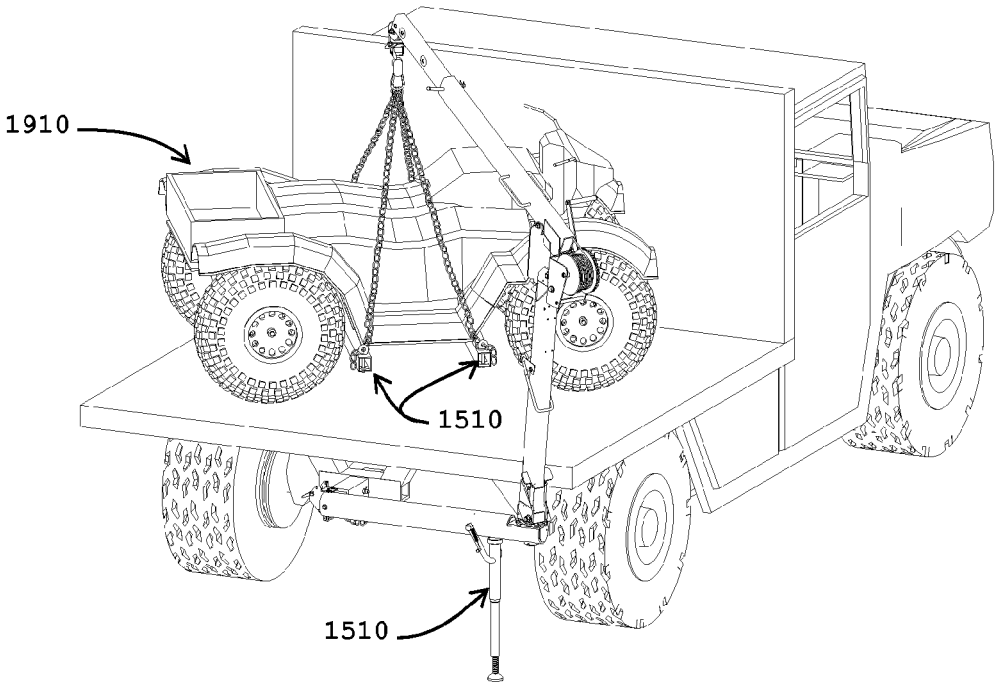
FIG. 20 shows a preferred embodiment of the present invention lifting an all-terrain vehicle into the back of a flatbed truck.

The present invention is well suited for most lifting applications. Spreaders 1920 should be used when lifting large objects such as lawn mowers, equipment, or all-terrain vehicles 1910. The kickstand style jig should also be deployed when lifting heavy loads; particularly those that approach the limit of the device that supports the mounting base. More than one lifting point should be used on the load as shown in FIG. 20 when using the present invention to lift large objects that may be difficult to control.

Figure 21:
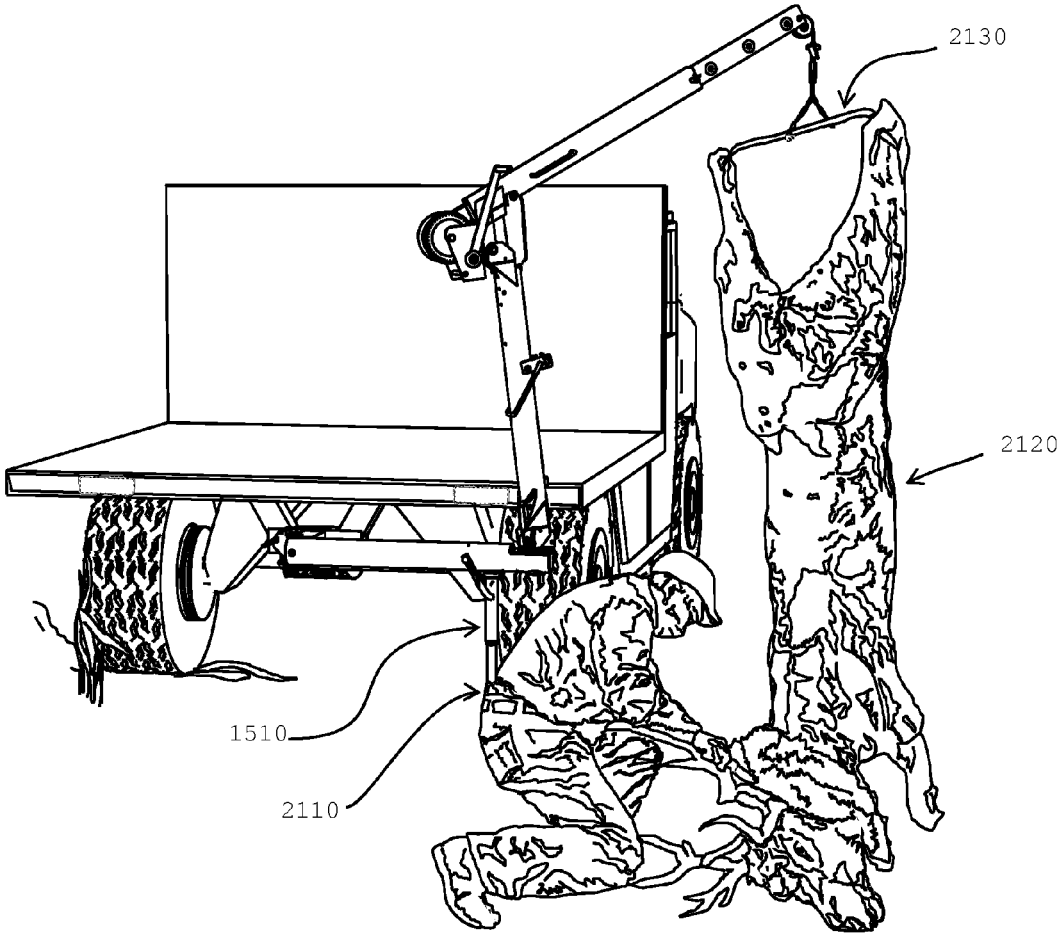
FIG. 21 shows a preferred embodiment of the present invention hoisting an elk while a hunter process it.

The present invention is well suited for hunting applications and can be used to winch in large game and to subsequently elevate the animal for processing. The exemplary application in FIG. 21 shows a bull elk that has been hoisted so that it can be processed in the field by a hunter. The lifting capacity of the embodiment shown in the figure exceeds the weight of the animal. This embodiment enables an individual hunter to process and load the large animal into a vehicle without assistance.

If the present invention is used to lift logs or other durable items, it may be beneficial to simply wrap the lifting cable of the hoist around the load and use the load coupling hook to form a noose with the cable as shown in FIG. 22. Caution should be exercised to ensure that the load, the hoist, and the host vehicle are capable of supporting the load.

Figure 23:
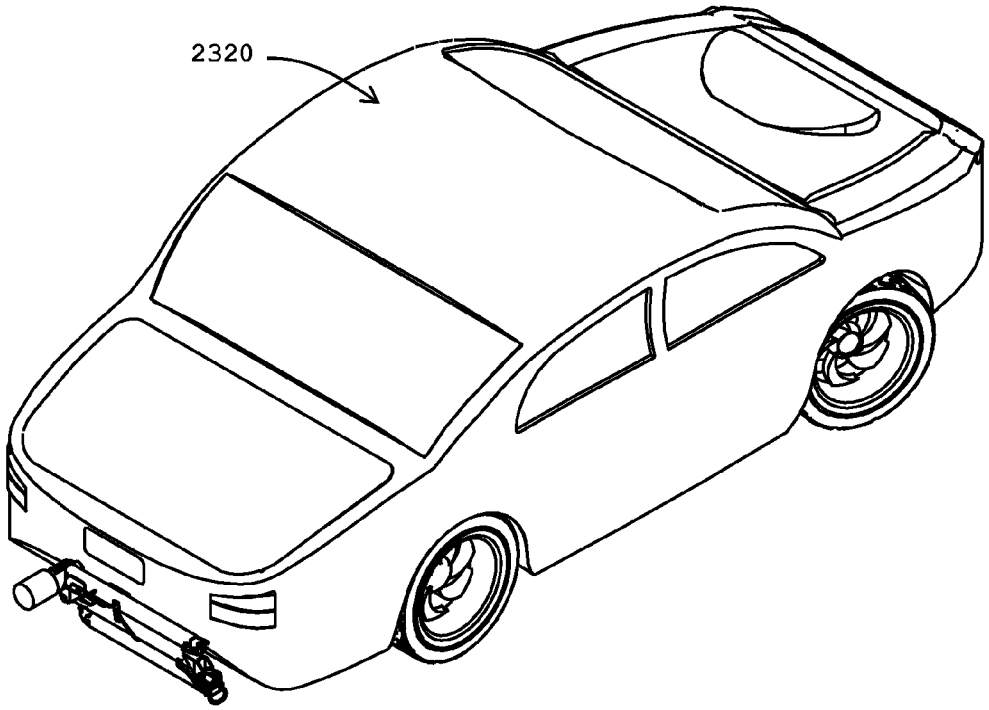
FIG. 23 shows a preferred embodiment of the present invention mounted to a sedan style vehicle.

The present invention is well suited for lifting powered mobility chairs and other light loads when affixed to the rear of a vehicle as shown in FIG. 23. Caution should be exercised to ensure that the load, the hoist, and the host vehicle are capable of supporting the load.

It is understood that the above embodiments and applications are merely illustrative of the possible specific applications which may represent principles of the present invention. Other embodiments may readily be devised in accordance with the principals herein by those skilled in the art without departing from the scope and spirit of this invention.

The invention claimed is:

1. A pivot shaft mountable folding crane apparatus comprising:

A boom with a proximal end and a distal end,

A stanchion with a proximal end and a distal end, the proximal end of the stanchion being hinge-coupled to the distal end of the boom about a first substantially horizontal axis, A pivoting hinge with a proximal end and a distal end, the pivoting hinge proximal end being hinge-attached to the distal end of the stanchion about a second substantially horizontal axis, such that the boom and stanchion can be folded into a non-operating state, and unfolded into an operating state with respect to the pivoting hinge;

A pivot shaft, with a distal end and a proximal end, rotatably attached to the pivoting hinge about a substantially vertical axis; wherein the distal end of the pivot shaft is mountable to a mounting base;

A boom lock, with a proximal end and a distal end, the proximal end of the boom lock being hinge-attached near the distal end of the boom about a third substantially horizontal axis, and the distal end of the boom lock comprising a boom lock contact surface;

The pivoting hinge comprising a pivoting hinge contact surface at a top portion of the pivoting hinge, the pivoting hinge tapering downwards from the pivoting hinge distal end to the pivoting hinge proximal end such that the pivoting hinge contact surface is higher at the pivoting hinge distal end than the pivoting hinge proximal end; The pivoting hinge further comprising a substantially vertical pivot opening through said pivoting hinge, the substantially vertical pivot opening configured for rotational operation and attachment to the pivot shaft;

The stanchion comprising a stanchion contact surface at the distal end of the stanchion such that the stanchion contact surface engages against the pivoting hinge contact surface as the stanchion is unfolded into the operating state; The stanchion further comprising a stanchion locking surface at the proximal end of the stanchion adapted to come into engagement with the boom lock contact surface as said crane apparatus is unfolded into the operating state, such that as the boom rotates into the operating state the boom lock rotates in an opposite sense with respect to boom rotation, the boom lock contact surface swinging into engagement with the stanchion locking surface which holds the boom in the operating state;

Wherein in the non-operating state the boom lock contact surface does not directly contact the stanchion locking surface; and in the operating state the boom lock contact surface directly contacts the stanchion locking surface such that a load suspended from the boom holds the boom in a locked position relative to the stanchion.

2. The folding crane of claim 1 wherein the pivot shaft distal end is affixed to a distal end of a mounting base, the mounting base having a proximal end with an insert adapted for recoverable insertion into a vehicle receiver hitch.

3. The folding crane of claim 1 wherein the pivot shaft distal end is affixed to a portable cart.

4. The folding crane of claim 1 wherein the pivot shaft distal end is affixed to a portable structure.

5. The folding crane of claim 1 wherein the pivot shaft distal end is affixed to a fixed structure.

6. The folding crane of claim 1 wherein the pivot shaft distal end is affixed to a vehicle.

7. The folding crane apparatus of claim 1 further comprising a plurality of latching mechanisms to hold the folding crane in the non-operating state.

8. The folding crane apparatus of claim 1 further comprising a tilt lock on the distal end of the stanchion to hold the folding crane in the operating state.

9. The folding crane apparatus of claim 1 further comprising an insert adapted for adjustable position insertion into the proximal end of the boom for the purpose of forming an extendable boom.

10. The folding crane apparatus of claim 1 further comprising a winch and a lifting line with an end adapted to lift objects.

11. The folding crane apparatus of claim 1 further comprising a plurality of actuators adapted to fold and unfold the stanchion relative to the pivoting hinge.

12. The folding crane apparatus of claim 1 further comprising a plurality of actuators adapted to raise and lower the boom relative to the stanchion when the folding crane is folded into the non-operating state and unfolded into the operating state.

13. The folding crane apparatus of claim 1 further comprising a lifting line attached to the boom with an end adapted to lift objects.

14. The folding crane apparatus of claim 1 further comprising an attachment at the distal end of the boom adapted for lifting objects.

15. The folding crane apparatus of claim 1 further comprising an appendage extending from the distal end of the boom having a thru-hole for hinge coupling to tabs which extend transversely from the proximal end of the stanchion thereby forming a hinge coupled attachment that minimizes the profile of the folding crane apparatus when the folding crane apparatus is folded into the non-operating state.

16. The folding crane apparatus of claim 1 further comprising an appendage extending from the distal end of the boom, the appendage comprising a mounting surface on one side for mounting a winch in a manner that minimizes the profile of the folding crane apparatus when the folding crane apparatus is folded into the non-operating state.

17. The folding crane apparatus of claim 1 further comprising a pair of tabs extending from the proximal end of the stanchion and a pair of tabs extending from the distal end of the stanchion, each pair of tabs having a mounting hole extending therethrough juxtaposed coaxially with respectively the first and second substantially horizontal axes, for hinge attachment to respectively the boom and pivoting hinge; wherein the tabs extend downward from the stanchion in the non-operating state in a manner that minimizes the profile of the folding crane apparatus when the folding crane apparatus is folded into a non-operating state.

18. A method of operating a folding crane, the folding crane comprising:

A boom with a proximal end and a distal end,

A stanchion with a proximal end and a distal end, the proximal end of the stanchion being hinge-coupled to the distal end of the boom about a first substantially horizontal axis, A pivoting hinge with a proximal end and a distal end, the pivoting hinge proximal end being hinge-attached to the distal end of the stanchion about a second substantially horizontal axis;

A pivot shaft, with a distal end and a proximal end, rotatably attached to the pivoting hinge about a substantially vertical axis;

A boom lock, with a proximal end and a distal end, the proximal end of the boom lock being hinge-attached near the distal end of the boom about a third substantially horizontal axis, and the distal end of the boom lock comprising a boom lock contact surface;

The pivoting hinge comprising a pivoting hinge contact surface at a top portion of the pivoting hinge, the pivoting hinge tapering downwards from the pivoting hinge distal end to the pivoting hinge proximal end such that the pivoting hinge contact surface is higher at the pivoting hinge distal end than the pivoting hinge proximal end; The pivoting hinge further comprising a substantially vertical pivot opening through said pivoting hinge, the substantially vertical pivot opening configured for rotational operation and attachment to the pivot shaft;

The stanchion comprising a stanchion contact surface at the distal end of the stanchion and a stanchion locking surface at the proximal end of the stanchion;

said method comprising the steps of:

unfolding the stanchion and boom, together as a unit, about the second substantially horizontal axis until the stanchion and boom are substantially vertical and the stanchion contact surface locks against the pivoting hinge contact surface;

unfolding the boom away from the stanchion about the first substantially horizontal axis until the boom lock drops and the boom lock contact surface contacts the stanchion locking surface, which causes the boom to lock into an operating state;

connecting a load coupler of the folding crane, that is attachable to a load, to a secure point on the load;

raise and lower the load, rotating the stanchion and boom assembly, and load to position the load;

rotating the stanchion and boom to position the load;

releasing the load coupler from the load;

releasing the boom lock contact surface from the stanchion locking surface;

lowering the boom out of the operating state about the first substantially horizontal axis until the boom rests against the stanchion, folding the stanchion and boom, together as a unit, about the second substantially horizontal axis until the stanchion and boom reach a non-operating state.

19. The method of claim 18 further comprising releasing a plurality of latches to unlock the foldable crane for unfolding of the stanchion and boom into the operating state.

20. The method of claim 18 further comprising engaging a plurality of latches to lock the folding crane into the non-operating state.

21. The method of claim 18 further comprising adjusting the position of a plurality of attachments adapted to allow the boom to extend in reach.

* * * * *